US006474887B2

(12) United States Patent
Ozu

(10) Patent No.: US 6,474,887 B2
(45) Date of Patent: Nov. 5, 2002

(54) APPLICATOR

(75) Inventor: Tatsuya Ozu, Kadoma (JP)

(73) Assignee: Sakura Color Products Corporation, Osaka (JP)

( * ) Notice: Subject to any disclaimer, the term of this patent is extended or adjusted under 35 U.S.C. 154(b) by 0 days.

(21) Appl. No.: 09/943,973

(22) Filed: Aug. 31, 2001

(65) Prior Publication Data

US 2002/0028102 A1 Mar. 7, 2002

(30) Foreign Application Priority Data

Sep. 5, 2000 (JP) ..... 2000-268739

(51) Int. Cl.[7] ..... B43K 5/00
(52) U.S. Cl. ..... 401/23; 401/196; 401/208
(58) Field of Search ..... 401/3, 23, 196, 401/198, 216, 205, 206, 52, 195, 208

(56) References Cited

U.S. PATENT DOCUMENTS 5,013,818 A * 5/1991 Takemura et al.
5,615,963 A 4/1997 Kobayashi
6,043,310 A * 3/2000 Liu et al. ..... 524/502
6,124,377 A * 9/2000 Kaiser et al. ..... 523/161

FOREIGN PATENT DOCUMENTS

JP 2000-79787 3/2000

* cited by examiner

*Primary Examiner*—Charles R. Eloshway
(74) *Attorney, Agent, or Firm*—Wood, Phillips, Katz, Clark & Mortimer

(57) ABSTRACT

An applicator with improved safety is provided. Even if the penpoint tip of the applicator has ignited, fire cannot spread over the tip holder. The applicator comprises a main body (2) forming a reservoir 3 to accommodate an occluding body (4) to occlude flammable liquid to be applied, penpoint tips (5,7), and tip holders (6,8). Each of the tip holders (6,8) is made of flame-retardant resin having an oxygen index more than 30 percent.

20 Claims, 2 Drawing Sheets

APPLICATOR

BACKGROUND OF THE INVENTION

1. Field of the Invention

The present invention relates to an applicator including a writing instrument, such as a marking pen and a felt pen, and a corrector of written letters or figures.

2. Description of Related Art

Construction of an applicator, which is mainly in use for writing letters, characters or figures, underlining, or putting in colors to outline pictures, is disclosed in U.S. Pat. No. 5,615,963, to Kobayashi, or Japanese Laid-open Patent Application 2000-79787.

The applicator disclosed by Kobayashi is equipped with a penpoint tip, a valve and a liquid reservoir containing liquid ink. When the valve is opened by compressing the penpoint tip against a surface, ink from the reservoir permeates into the penpoit tip and then exudes from the tip.

In the applicator disclosed in Japanese Laid-open Patent Application 2000-79787, a "shaft tube" or a hollow main body accommodates an ink-occluding body, which occludes ink. A penpoint tip attached to an end of the main body exudes ink.

Either of the applicators described above is composed of a main body and a penpoint tip. Liquid to be applied, such as ink, is reserved in the main body and the penpoint tip is attached to an end of the main body via a tip holder.

Most of tip holders of prior art applicators are made of commonly used synthetic resin, which is flammable. In most cases, liquid in the reservoir contains flammable solvent such as alcohol and ether.

When a prior art applicator is kept uncapped, whether the applicator is being used or whether it has been left uncapped, the penpoint tip of the applicator is kept exposed to the outer air. Therefore, the solvent exudes and vaporizes from the tip and thus flammable vapor spreads into the surrounding atmosphere, incurring danger of taking fire. A child might set fire to the penpoint tip by mischief.

Once the vapor that has spreaded from the penpoint tip catches fire, not only the solvent occluded in the tip burns, but also the tip itself ignites as the resin constituting the tip reaches flammable temperature, generating more heat. Then the tip holder ignites and finally the liquid in the main body burns, thus generating much more heat. If a curtain or a carpet in a room might catch fire, it might be more dangerous.

In Japan, flame retardancy evaluating test is formulated by means of Japanese Industrial Standards JIS A1321. Recently ACMI Standard to evaluate flame retardancy is also applied in Japan. However, to my knowledge, no applicator having a penpoint tip or a tip holder made of resin has met the requirement of the JIS or the ACMI Standard.

SUMMARY OF THE INVENTION

The present invention is directed to solve the problem pointed out above, and has for its object to provide an inexpensive and convenient applicator having less combustibility and improved safety.

An aspect of the invention to solve the problem is an applicator comprising;

a main body containing flammable liquid to be applied;

a tip holder; and a penpoint tip attached to the main body via the tip holder:

wherein the tip holder is made of flame-retardant resin.

The resin may be synthetic resin or natural resin.

Possibility of ignition of the penpoint tip cannot be avoided insofar as a flammable solvent is contained in the ink. However, even if the penpoint tip of the applicator of the invention has ignited, fire cannot spread over the tip holder, as the tip holder is made of a flame-retardant resin. Therefore, fire on the penpoint tip of the applicator cannot spread to the ink in the main body.

Preferably the flame-retardant resin has an oxygen index more than 30 percent.

The term "oxygen index" is an index representing flame-retardant or noncombustible degree and identified by Japanese Industrial Standards JIS K7201. More specifically, an "oxygen index" is identified as "a percentage of a minimum density of oxygen necessary for maintaining combustion of a tested material for a predetermined time". Consequently, if the oxygen index of the material exceeds 21 percent, combustion of the material in normal air hardly continues. The flame retardancy of the material increases with the oxygen index.

The inventor has found that the oxygen index of the flame-retardant resin constituting the tip holder of an applicator containing normal flammable ink should be more than 30 percent to meet the requirement of JIS and ACMI.

Based on this point, the above-described aspect of the invention prevents fire on the penpoint tip from spreading to the ink in the main body.

Preferably the flame-retardant resin consists essentially of:

(a) at least one selected from the group consisting of polybutylene terephthalate, polyolefin, polycarbonate and ABS resin (acrylonitrilebutadiene-styrene resin) and (b) inorganic substance.

ABS resin may be made by any known method, for example, by graft copolymerization or by polymer-blending.

More specifically, it is preferred that inorganic metal compound, such as antimony oxide, or glass fiber is contained in the flame-retardant resin. A flame-retardant resin containing inorganic substance such as monoammonium phosphate, boric acid, and metal fiber may be utilized. A flame-retardant resin containing ceramics such as zirconia and boron nitride as inorganic substance may also be utilized.

Most of publicly known highly flame-retardant resins are expensive or difficult to mold because of their high melting point. The inventor made tests to select resins suitable for the material of the tip holder among a lot of frame-retardant resins. The invention is based on these tests. As most of the inks contained in non-aqueous marking pens etc. contain alcohol and/or ether as a solvent, which has a relatively moderate combustibility, the above-described resin, which is obtained by mixing inorganic substance such as inorganic metal compound and/or glass fiber with at least one selected from the group consisting of polybutylene terephthalate, polyolefin, polycarbonate and ABS resin, shows a flame retardancy sufficient for practical use. Additionally, the above-described flame-retardant resin is easy to mold.

Preferably, the flame-retardant resin contains inorganic substance more than 15 percent by weight of the flame-retardant resin.

More preferably, the flame-retardant resin contains inorganic metal compound and/or glass fiber more than 15 percent by weight of the flame-retardant resin.

The flame-retardant resin may include a flame-retardant agent. The flame-retardant agent may be at least one selected from the group consisting of a chloride flame-retardant agent, a bromide flame-retardant agent, a phosphate flame-retardant agent, and an inorganic flame-retardant agent.

Though composition of liquid contained in the main body may be selected at user's option, alcohol, ether, ketone, or mixture thereof may be employed as solvent. Noncombustible solvent such as water may be contained in the liquid.

The penpoint tip may also be made of flammable material.

More specifically, the penpoint tip may be made essentially of acrylic resin or polyacetal.

The main body may also be made of flammable material.

Preferably the penpoint tip is in close contact with the tip holder.

In another aspect of the invention, the applicator includes:

a main body containing flammable liquid to be applied;

a tip holder; and a penpoint tip attached to the main body via the tip holder:

wherein the main body and the tip are made of flammable material;

wherein the liquid contains alcohol, ether and/or ketone as solvent;

wherein the tip holder is made of a composite material consisting essentially of:

(a) a resin and (b) inorganic metal compound and/or glass fiber more than 15 percent by weight of the composite material.

In a still other aspect of the invention, the applicator includes:

a main body containing flammable liquid to be applied;

a tip holder; and a penpoint tip attached to the main body via the tip holder:

wherein the liquid contains alcohol, ether and/or ketone as solvent;

wherein the tip holder is made of a composite material consisting essentially of:

(a) at least one selected from the group consisting of polybutylene terephthalate, polyolefin, polycarbonate and ABS resin and (b) inorganic substance; and wherein an oxygen index of the resin is more than 30 percent.

As the penpoint tip of the applicator of this aspect is made of flame-retardant resin that has an oxygen index more than 30 percent, fire on the penpoint tip cannot spread over the tip holder. Especially the solvent of the contained liquid is one compound selected from the group consisting of alcohols, ethers, and ketones or mixture of compounds selected from the group consisting of alcohols, ethers, and ketones, heat generating from combustion of the solvent is not enough to burn the tip holder compulsorily or to melt the tip holder. Additionally, the tip holder is easy to mold.

THE BEST MODE OF CARRYING OUT THE INVENTION

Figure 1:
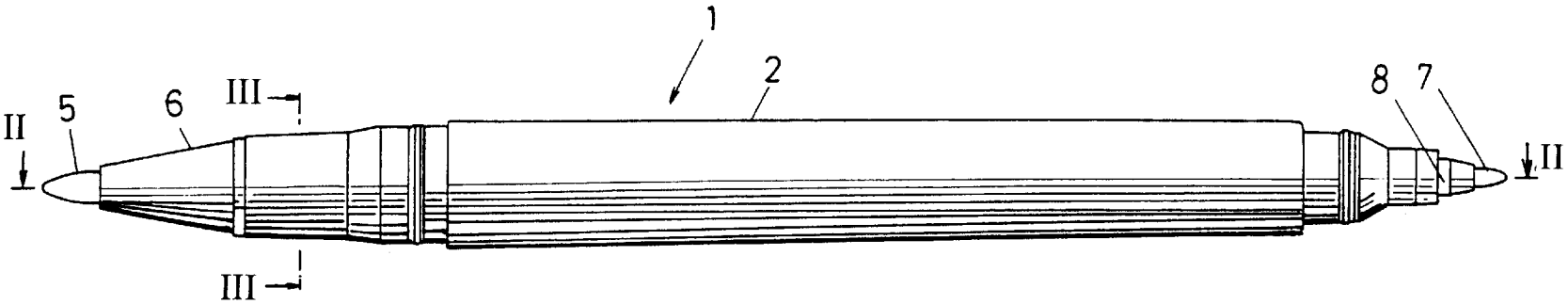
FIG. 1 is a front elevational view showing an embodiment of the applicator of this invention.

Now some preferred embodiments of the present invention will be described referring to the accompanying drawings.

An applicator 1, which is also an writing instrument, consists of a main body 2, a first penpoint tip 5 for drawing broad lines attached to an end of the main body 2, and a second penpoint tip 7 with a smaller diameter for drawing thin lines attached to the other end of the main body 2.

More specifically, the applicator 1 has a main body 2, which is hollow and nearly cylindrical, made of polypropylene. A reservoir 3 is formed within the main body 2 so as to contain liquid to be applied. In this embodiment, a tube 10 which is not unitary with the main body 2 is further housed in the reservoir 3 within the body 2. The tube contains an occluding body 4 made of synthetic cotton, which occludes the liquid to be applied, for example, writing ink. The liquid contains alcohol, such as methanol and ethanol, as solvent.

Alternatively, the liquid may contain ether, such as ethyl ether, as solvent. The liquid may contain ketone, such as methyl isobutyl ketone, as solvent.

The first tip 5 is attached to an end (left side in FIG. 1 and FIG. 2) of the main body 2 via a first tip holder 6. The first tip 5 has a shape like a writing brush. More specifically, the tip 5, which is formed by sticking acrylic fibers together, absorbs the liquid from the occluding body 4 in the reservoir 3 by capillary phenomenon.

The first tip holder 6 consists of a nearly conical distal portion 6*a,* a nearly cylindrical proximal portion 6*b,* and a flange portion 6*c* between the other two portions. Ribs 6*d* are formed inside the proximal portion 6*b.* A through-hole extends axially from the distal end to the proximal end of the tip holder 6. The first tip S is inserted into the through-hole and retained by the ribs 6*d.* The outer diameter of the tip 5 is slightly greater than the inner diameter of the through-hole before assembling. On assembling, the tip 5 is forced to fit into the through-hole of the tip holder 6, with being compressed radially. Then the holder 6 holding the tip 5 is attached to the main body 2. Therefore, the first tip 5 is in close contact with the inner surface of the through-hole of the tip holder 6.

An end of the tip 5 protrudes from the distal end of the tip holder 6, whereas another end of the tip 5 plunges through the proximal end of the holder 6 into inside of the reservoir 3 and is in contact with the occluding body 4.

The tip holder 6 of the applicator 1 is made of flame-retardant resin, more specifically, mixture consisting essentially of polybutylene terephthalate and inorganic metal compound and/or glass fiber and having an oxygen index more than 30 percent.

The tip holder 6 can also be made from other resin such as resin consisting essentially of at least one selected from the group consisting of polyolefin, polycarbonate or ABS resin (acrylonitrile-butadiene-styrene resin). To form the tip holder 6, at least one noncombustible inorganic substance is mixed with such other resin to adjust the oxygen index more than 30 percent.

Though most of the tip holders 6 are made of synthetic resin described above, the tip holder 6 can also be made of natural resin such as natural rubber which is made flame-retardant.

Though an inorganic metal compound or a glass fiber is a typical noncombustible inorganic substance, other inorganic substances may be used.

An inorganic metal compound such as antimony oxide may be used. Other noncombustible inorganic substance such as monoammonium phosphate, boric acid, metal fiber, and ceramic, for example, zirconia or boron nitride, may be used.

The amount of inorganic metal compound and/or glass fiber contained in the flame-retardant resin may be selected at user's option considering flame retardancy and moldability. Preferably the amount is in the range of 15 to 50 percent by weight of the flame-retardant resin, because sufficient flame retardancy is hardly available if the amount is less than 15 percent by weight, whereas sufficient moldability is hardly available if the amount is more than 50 percent by weight.

The second tip 7 is attached to the other end (right side in FIG. 1 and FIG. 2) of the main body 2 via a second tip holder 8. The second tip 7, made of a porous body formed mainly of polyacetal drawn linearly, absorbs the liquid from the occluding body 4 in the reservoir 3 by capillary phenomenon.

The second tip holder 8 is almost cylindrical and smaller in length and diameter than the first tip holder 6. The second tip 7 is fitted into the second holder 8. The second tip 7 is in close contact with the inner surface of the through-hole of the tip holder 8.

Similar to the first tip holder 6, the tip holder 8 is made of flame-retardant resin, more specifically, resin consisting essentially of polybutylene terephthalate and inorganic metal compound and/or glass fiber and having an oxygen index more than 30 percent. Other flame-retardant resin, such as mixture consisting essentially of at least one selected from the group consisting of polyolefin, polycarbonate and ABS resin and inorganic metal compound and/or glass fiber and having an oxygen index more than 30 percent, may be adapted to form the tip holder 8.

Preferably the amount of inorganic metal compound and/or glass fiber contained in the flame-retardant resin is in the range of 15 to 50 percent by weight of the frame-retardant resin, for the same reason that has been described with the first tip holder 6.

An end of the tip 7 protrudes from the distal end of the tip holder 8, whereas another end of the tip 7 plunges through the proximal end of the holder 8 into inside of the reservoir 3 and is in contact with the occluding body 4.

Caps (not shown) are to be mounted on the both ends of the main body 2.

The applicator 1 can be used in the identical manner to the prior art applicator. More specifically, when the first penpoint tip 5 for broad lines is used, the liquid that has spreaded into the first tip 5 by capillary phenomenon from the occluding body 4 in the reservoir 3 exudes from the tip 5.

Similarly, when the second penpoint tip 7 for thin lines is used, the liquid that has spreaded into the second tip 7 by capillary phenomenon from the occluding body 4 in the reservoir 3 exudes from the tip 7. Thus the applicator 1 can be used for applying liquid on the surface of paper etc. so as to write letters, characters and figures, to underline, and to put in colors to outline pictures by selectively using one of the penpoint tips 5, 7.

As described above, the main body 2 of the applicator 1 is made of polypropylene and the penpoint tips 5, 7 are made of acrylic resin or polyacetal. Therefore, the penpoint tips 5, 7 and the main body 2 are flammable. However, even if one of the penpoint tips 5, 7 is ignited, fire on the tip cannot spread over the adjacent tip holder 6 or 8 to the main body 2 as the tip holders 6, 8, which connect the main body 2 and the tips 5, 7, are made of flame-retardant resin.

For example, if a flame exists near the penpoint tip 7 of the applicator 1, alcohol vapor that has vaporized from the liquid occluded in the penpoint tip and spreaded into the atmosphere catches fire. Then alcohol occluded in the tip 7 ignites and in turn the tip itself ignites as the resin constituting the tip reaches flammable temperature. However, the tip holder 8 does not ignite as it is made of flame-retardant resin. In the course of time, the portion of the tip 7 that is exposed externally burns off or melts and drops off. As a result, the fire on the tip 7 is extinguished as the member to transfer the liquid from the main body 2 to outside is lost. As if a wick of a candle is lost, the fire goes out spontaneously if the tip 7 is lost. As the portion of the tip 7 that is exposed externally is small, the duration of fire on the tip 7, from ignition to extinction, is short.

Moreover, both the liquid, which contains alcohol as solvent, and the tip itself generate too small amounts of combustion heat to melt the tip holder 8. Therefore, neither the holder 8 is destroyed, nor the liquid leaks out by destruction of the holder 8. As the tip 7 is in close contact with the inner surface of the through-hole of the tip holder 8, fire on the tip 7 cannot ignite to the main body 2.

Therefore, even if the second penpoint tip 7 of the applicator 1 takes fire, it is not seriously dangerous. For similar reason, even if the first penpoint tip 5 takes fire, it is not seriously dangerous.

Though in the embodiment described above the tip holder 6 is made of synthetic resin containing an inorganic substance, a resin with improved retardancy by containing at least one retardant agent, whether organic or inorganic, may be used.

More specifically, polybutylene terephthalate, polyolefin, polycarbonate, ABS resin, or mixture thereof with improved retardancy by containing at least one retardant agent selected from the group consisting of a chloride flame-retardant agent, a bromide flame-retardant agent, a phosphate flame-retardant agent, and an inorganic flame-retardant agent may be used.

As a typical chloride flame-retardant agent, paraffin chloride, polyethylene chloride, perchlorocyclopentadecane, chlorendic acid, or tetrachlorophthalic anhydride may be used.

As a typical bromide flame-retardant agent, tetrabromobisphenol A, decabromodiphenylether, tetrabromodiphenylether, hexabromobenzene, hexabromocyclodecane, or tetrabromophthalic anhydride may be used.

As a typical phosphate flame-retardant agent, ammonium polyphosphate, triethyl phosphate, tricresyl phosphate, tris (β-chloroethyl)phosphate, phosphoric ester containing nitrogen, polymerizable phosphorus compound monomer, or red phosphorus retardant agent may be used.

As a typical inorganic flame-retardant agent, aluminum hydroxide, magnesium hydroxide, diantimony trioxide, molybdenum compound, zirconium, zinc borate, guanidine nitride, calcium carbonate, tin oxide, or diphosphorus pentaoxide may be used.

Figure 2:
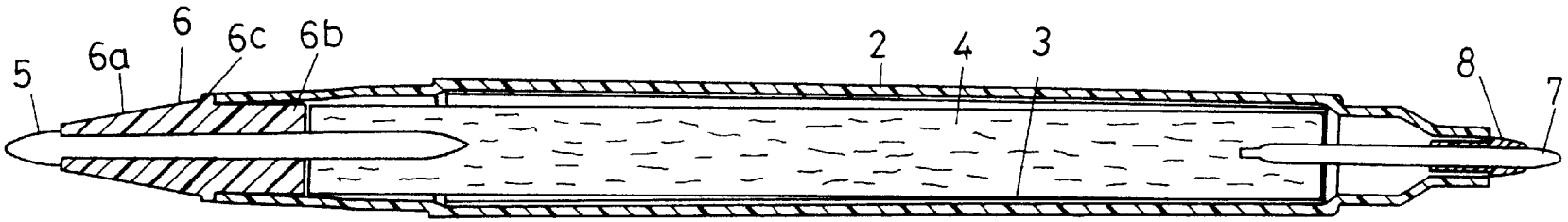
FIG. 2 is a sectional view taken along line II—II of FIG. 1.
Figure 3:
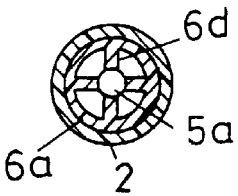
FIG. 3 is a sectional view taken along line III—III of FIG. 1.

An applicator 1 illustrated in FIG. 1 is experimentally produced to determine the effect of this invention. Either of tip holders 6, 8 is made of polybutylene terephthalate resin whose flame retardancy is reinforced by mixing 20 percent (by weight) inorganic glass fiber. The resin has an oxygen index more than 30 percent and meets the requirement of the flame retardancy evaluating test formulated by means of Japanese Industrial Standards JIS A1321.

After ink containing as solvents 20 percent (by weight) isopropyl alcohol and 61.5 percent (by weight) ethylene glycol monomethyl ether was filled into the tube 10 within the main body 2 and the ink permeated the occluding body 4 in the tube 10, an ignition test was carried out. More specifically, the second penpoint tip 7 was ignited compulsorily by means of a cigar lighter. When one minute passed since the ignition, the second penpoint tip 7 was still burning, whereas the second tip holder 8 was not burning. Several seconds later, the tip 7 burnt off and the fire spontaneously went out.

Similarly, the first penpoint tip 5 was ignited compulsorily by means of a cigar lighter. When one minute passed since the ignition, the first penpoint tip 5 was still burning, whereas the first tip holder 6 was not burning. Several seconds later, the tip 5 burnt off and the fire spontaneously went out.

By these tests it proved that fire on the tip 5,7 of the applicator will spontaneously go out, thus enhancing safety.

For comparison, an applicator having a construction almost identical with the above-described applicator 1, hereinafter called "reference applicator", is experimentally produced. It is described using identical numerals for identical or similar members. The reference applicator differs from the applicator 1 of above embodiment, hereinafter called "inventive applicator", in having tip holders 6, 8 made of different material from that of the inventive applicator 1. More specifically, the tip holders 6, 8 of the reference applicator are made of polyacetal having an oxygen index of about 16 percent.

Similar to the test to the inventive applicator 1, the second penpoint tip 7 of one piece of the reference applicator was ignited compulsorily by means of a cigar lighter. Within one minute from the ignition, flame spreaded over the tip holder 8 and to the main body 2.

Also within one minute from igniting the first penpoint tip 5 of another piece of the reference applicator, flame spreaded over the tip holder 6 and to the main body 2.

Though the applicator 1 of the embodiment accommodates the occluding body 4 in the main body 2 to contain flammable liquid to be applied, the invention can be used in an applicator containing the flammable liquid directly in the main body 2 without providing the occluding body.

Even if the penpoint tip of the applicator of the invention catches fire from any origin in using the applicator or in leaving it uncapped, the fire stops, only destroying the penpoint tip, as the tip holder is made of flame-retardant resin, thus preventing damage from increasing. As described heretofore, the applicator of the invention has an improved safety.

As the resins used for the applicator of the invention are widely placed on the market and easy to form, the applicator is suitable for mass production and involves little increase of manufacturing cost.

It is to be understood that the invention is not limited to the specific embodiments thereof. Many apparently widely different embodiments of this invention may be made without departing from the spirit and scope thereof.

What is claimed is:

1. Applicator comprising:

a main body containing flammable liquid to be applied;

a tip holder; and a penpoint tip attached to the main body via the tip holder;

wherein the tip holder is made of flame-retardant resin.

2. The applicator according to claim 1, wherein the flame-retardant resin has an oxygen index of more than 30 percent.

3. The applicator according to claim 1, wherein the flame-retardant resin consists essentially of:

(a) at least one selected from the group consisting of polybutylene terephthalate, polyolefin, polycarbonate and ABS resin and (b) inorganic substance.

4. The applicator according to claim 1, wherein the flame-retardant resin consists essentially of:

(a) at least one selected from the group consisting of polybutylene terephthalate, polyolefin, polycarbonate and ABS resin and (b) inorganic metal compound and/or glass fiber.

5. The applicator according to claim 1, wherein the flame-retardant resin contains inorganic substance more than 15 percent by weight of the flame-retardant resin.

6. The applicator according to claim 1, wherein the flame-retardant resin contains inorganic metal compound and/or glass fiber more than 15 percent by weight of the flame-retardant resin.

7. The applicator according to claim 1, wherein the flame-retardant resin contains a flame-retardant agent.

8. The applicator according to claim 7, wherein the flame-retardant agent is at least one selected from the group consisting of a chloride flame-retardant agent, a bromide flame-retardant agent, a phosphate flame-retardant agent, and an inorganic flame-retardant agent.

9. The applicator according to claim 1, wherein the liquid contains alcohol, ether and/or ketone as solvent.

10. The applicator according to claim 1, wherein the penpoint tip is made of flammable material.

11. The applicator according to claim 1, wherein the penpoint tip is made essentially of acrylic resin or polyacetal.

12. The applicator according to claim 1, wherein the main body is made of flammable material.

13. The applicator according to claim 1, wherein the penpoint tip is in close contact with the tip holder.

14. Applicator comprising:

a main body containing flammable liquid to be applied;

a tip holder; and a penpoint tip attached to the main body via the tip holder;

wherein the main body and the tip are made of flammable material;

wherein the liquid contains alcohol, ether and/or ketone as solvent;

wherein the tip holder is made of a composite material consisting essentially of:

(a) a resin and (b) inorganic metal compound and/or glass fiber more than 15 percent by weight of the composite material.

15. The applicator according to claim 14, wherein the resin is at least one selected from the group consisting of polybutylene terephthalate, polyolefin, polycarbonate and ABS resin.

16. The applicator according to claim 14, wherein the penpoint tip is essentially made of acrylic resin or polyacetal.

17. The applicator according to claim 14, wherein the penpoint tip is in close contact with the tip holder.

18. Applicator comprising:

a main body containing flammable liquid to be applied;

a tip holder; and a penpoint tip attached to the main body via the tip holder;

wherein the liquid contains alcohol, ether and/or ketone as solvent, wherein the tip holder is made of a composite material consisting essentially of:

(a) at least one selected from the group consisting of polybutylene terephthalate, polyolefin, polycarbonate and ABS resin and (b) inorganic substance; and wherein an oxygen index of the material is more than 30 percent.

19. The applicator according to claim 18, wherein the penpoint tip is essentially made of acrylic resin or polyacetal.

20. The applicator according to claim 18, wherein the penpoint tip is in close contact with the tip holder.

* * * * *